US012270265B2

(12) United States Patent
Horst et al.

(10) Patent No.: US 12,270,265 B2
(45) Date of Patent: Apr. 8, 2025

(54) MECHANICAL DISCONNECT FOR ROTATION DRIVE

(71) Applicant: The Charles Machine Works, Inc., Perry, OK (US)

(72) Inventors: David L. Horst, Ashland, OH (US); BJ Burky, Burbank, OH (US); Tim Casey, Wooster, OH (US); Richard B. Gentry, Jeromesville, OH (US); Stuart Riggenbach, Wooster, OH (US); Aaron Edward Traxler, Columbia Station, OH (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 18/404,395

(22) Filed: Jan. 4, 2024

(65) Prior Publication Data

US 2024/0151112 A1 May 9, 2024

Related U.S. Application Data

(60) Division of application No. 17/838,402, filed on Jun. 13, 2022, now Pat. No. 11,898,405, which is a (Continued)

(51) Int. Cl.
*E21B 19/16* (2006.01)
*E21B 7/04* (2006.01)
(Continued)

(52) U.S. Cl.
CPC ..... *E21B 19/16* (2013.01); *E21B 7/046* (2013.01); *E21B 7/28* (2013.01); *E21B 19/08* (2013.01)

(58) Field of Classification Search
CPC . E21B 19/16; E21B 7/046; E21B 7/28; E21B 19/08
See application file for complete search history.

(56) References Cited

U.S. PATENT DOCUMENTS 2,320,571 A * 6/1943 Curtis ..... E21B 19/081 91/12
2,667,820 A 2/1954 Vlieg
(Continued)

FOREIGN PATENT DOCUMENTS

GB 727603 A 4/1955

OTHER PUBLICATIONS

SAI "SAI Hydraulic Motors Maintenance Manual T Series", catalog, undated, 32 pages, Italy.
(Continued)

*Primary Examiner* — Dany E Akakpo
(74) *Attorney, Agent, or Firm* — Tomlinson McKinstry, P.C.

(57) ABSTRACT

A horizontal directional drilling system. The system has a pilot drill and an exit side drill, with a drill string extending between them. A backreamer is positioned between the drills to enlarge a borehole. The pilot drill pulls and rotates the backreamer. The exit side drill adds segments to the product pipe and pushes the product pipe into the enlarged borehole. The exit side drill is equipped with a rotational disconnect. The disconnect is engaged to allow torque transfer between a motor and a spindle when adding segments to the product pipe. The disconnect is disengaged to prevent torque transfer between the motor and the spindle when pushing the product pipe into the enlarged borehole.

18 Claims, 13 Drawing Sheets

Related U.S. Application Data continuation of application No. 16/738,027, filed on Jan. 9, 2020, now Pat. No. 11,359,444, which is a continuation-in-part of application No. 15/853,156, filed on Dec. 22, 2017, now Pat. No. 10,563,458.

(60) Provisional application No. 62/438,134, filed on Dec. 22, 2016.

(51) Int. Cl.
*E21B 7/28* (2006.01)
*E21B 19/08* (2006.01)

(56) References Cited

U.S. PATENT DOCUMENTS

| | | | | |
|---|---|---|---|---|
| 3,470,968 | A | 10/1969 | Melsheimer et al. | |
| 3,889,765 | A | 6/1975 | Henson | |
| 4,078,452 | A | 3/1978 | Rosler | |
| 7,134,513 | B1 | 11/2006 | Randall et al. | |
| 7,628,226 | B2 | 12/2009 | Mitchell et al. | |
| 2002/0066598 | A1 | 6/2002 | Rozendaal et al. | |
| 2003/0226691 | A1* | 12/2003 | Youan | E21B 21/08 175/38 |
| 2005/0161261 | A1* | 7/2005 | Betts | E21B 7/30 175/73 |
| 2009/0095526 | A1 | 4/2009 | Lane et al. | |
| 2013/0028664 | A1 | 1/2013 | Cherrington | |
| 2013/0068490 | A1 | 3/2013 | Van Zee et al. | |
| 2013/0186662 | A1 | 7/2013 | Argent et al. | |
| 2014/0050522 | A1 | 2/2014 | Slaughter, Jr. et al. | |
| 2016/0069136 | A1 | 3/2016 | Metcalf et al. | |
| 2018/0163475 | A1 | 6/2018 | Barbera | |
| 2018/0179822 | A1* | 6/2018 | Horst | E21B 7/28 |

OTHER PUBLICATIONS

SAI "SAI Hydraulic Motor GS Series Motors", catalog, undated, 35 pages, Italy.

* cited by examiner

MECHANICAL DISCONNECT FOR ROTATION DRIVE

SUMMARY

The present invention is directed to a method of installing an underground pipe using a system. The system comprises a pilot horizontal directional drill, a pilot drill string having a first end and a second end, in which the first end is operatively connected to the pilot horizontal directional drill, and a product pipe section. The system further comprises an exit-side horizontal directional drill comprising a rotary spindle and a rotary motor coupled to the spindle. The method comprises the steps of rotating and advancing the pilot drill string to an exit point using the pilot horizontal directional drill, connecting the product pipe section to the spindle, and rotating the product pipe section using the spindle in order to connect the product pipe section to the second end of the pilot drill string, in which rotation of the spindle is driven by the motor. The method further comprises the steps pulling and rotating the product pipe section using the pilot horizontal directional drill, and simultaneously with the step of pulling and rotating the product pipe section, pushing the product pipe section into the ground with the spindle.

The present invention is also directed to a method of using a drilling system. The drilling system comprises a pilot drill, a pilot drill string having a first end and a second end, in which the first end is operatively connected to the pilot drill, and a drilling tool attached to the pilot drill string at its second end. The drilling system further comprises a product pipe attached to the drilling tool, and an exit-side drill. The exit-side drill comprises a spindle operatively connected to the product pipe, and a motor coupled to the spindle. The method comprises the steps of pulling and rotating the pilot drill string with the pilot drill, and pushing the product pipe with the exit-side drill while the spindle drives rotation of at least a portion of the motor.

The present invention is further directed to a method of using a horizontal directional drilling system. The system comprises an exit-side horizontal directional drill and a pilot horizontal directional drill. The exit-side horizontal directional drill comprises a rotationally-driven spindle coupled to a drill string, and a rotary motor coupled to the spindle. The motor is configured to operate in a first and second condition. The motor rotationally drives the spindle in the first condition and the spindle rotationally drives at least a portion of the motor in the second condition. The drill string is disposed between the exit-side horizontal directional drill and the pilot horizontal directional drill. The method comprises the steps of pulling and rotating the drill string with the pilot drill, and pushing the drill string with the exit-side horizontal directional drill while the motor is in the second condition.

DETAILED DESCRIPTION

Figure 1:
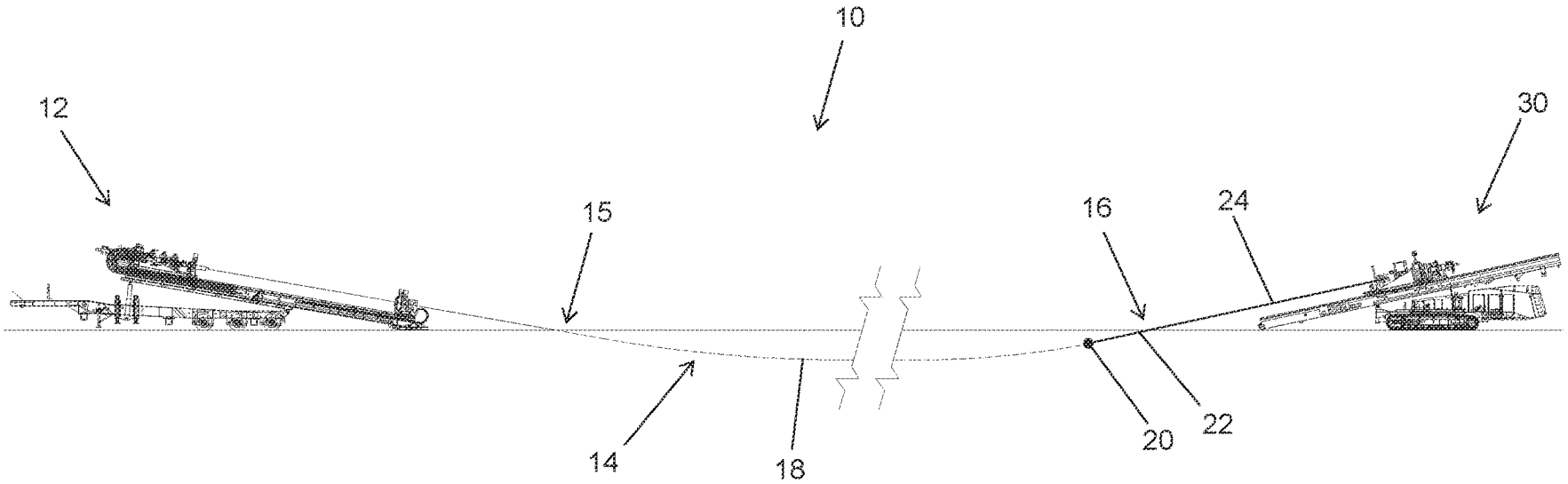
FIG. 1 is a diagrammatic representation of a drilling system.

Turning now to FIG. 1, a drilling system 10 with two drills is shown. The drilling system 10 is configured to install an operational "product pipe" underground, which may be a water, sewer, gas, or other conduit. The drilling system comprises a first drill, or pilot drill 12. The pilot drill 12 provides thrust and rotation to a pilot drill string 14 to advance a distal end of the pilot drill string from an entry point 15 to an exit point 16. The operation creates a "pilot bore" 18 underground extending from the pilot drill 12 to the exit point 16.

In many drilling operations, the pilot bore 18 does not have a sufficient diameter for a product pipe. In these operations, a backreamer 20 may be attached to the distal end of the pilot drill string 14 at the exit point 16. The pilot drill 12 then retracts and rotates the pilot drill string 14. The backreamer 20 enlarges the pilot bore 18 to form an enlarged bore 22. The backreamer 20 may be attached to segments of product pipe 24. Thus, as the backreamer 20 is pulled back toward the pilot drill 12, the product pipe 24 is installed.

In large installation operations, a force required to enlarge the pilot bore 18 and pull the product pipe 24 may be significant. Further, the product pipe 24 is preferably attached in segments having complimentary threaded ends. A second, or exit side drill 30 located at the exit point 16 provides torque to connect new segments to the installed product pipe 24. The second drill 30 additionally provides thrust force to the product pipe 24 and therefore the backreamer 20. This force assists the pilot drill 12 in enlarging the pilot bore 18.

Figure 2:
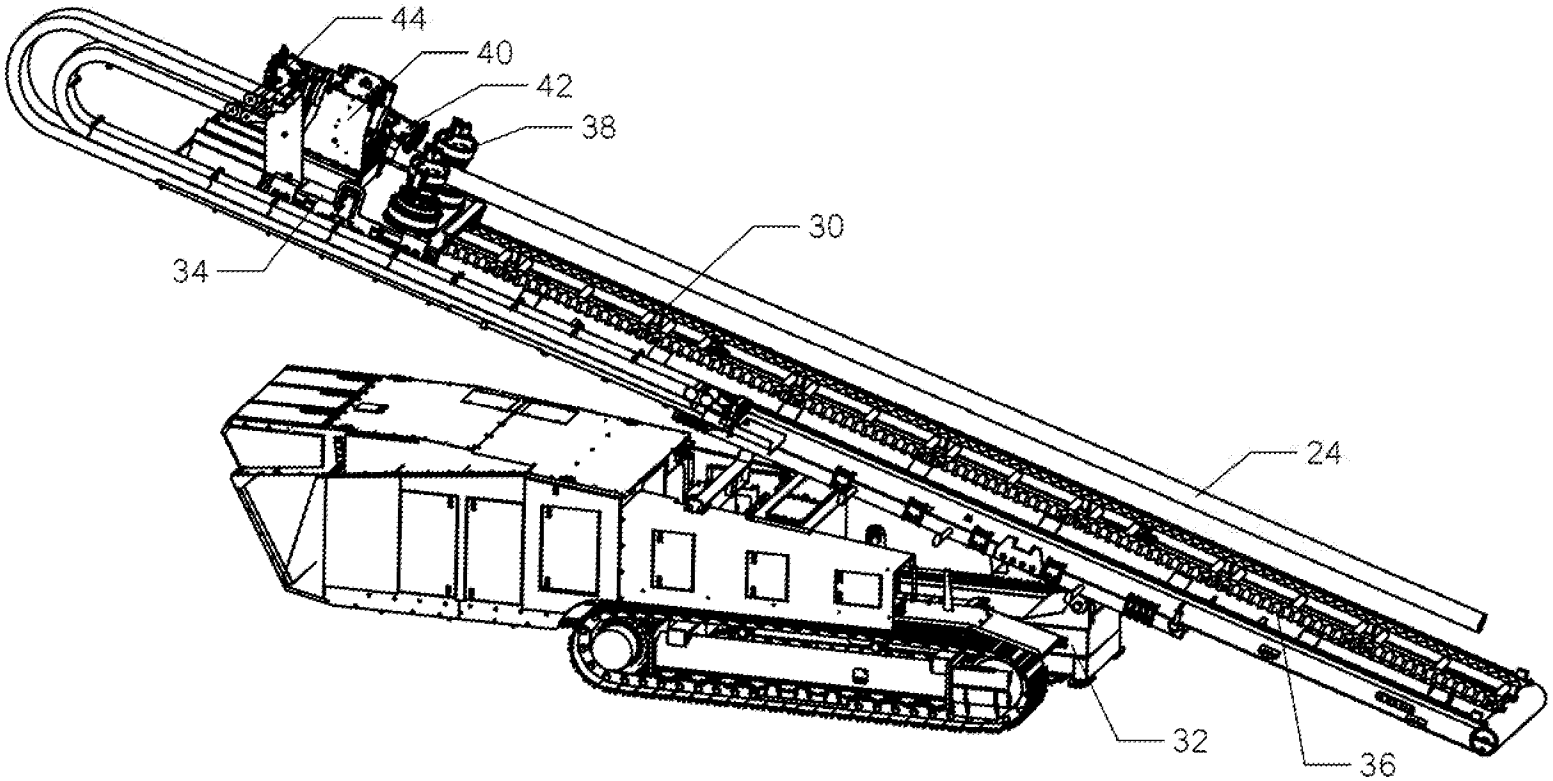
FIG. 2 is a side view of an exit side drill for use with the drilling system.

With reference to FIG. 2, the second drill 30 is shown. The second drill 30 comprises a frame 32 and a carriage 34 movable along the frame. The carriage 34 may be moved relative to a length of the frame 32 to provide thrust to the product pipe 24. The carriage 34 may be supported on and translated along a rack 36 and pinion system or other structure for moving along a linear path. As shown, pinion motors 38 turn pinions (not shown) to move the carriage 34 along the frame 32.

The carriage 34 supports a spindle assembly 40. The spindle assembly 40 comprises a spindle 42 for connecting to and providing rotational force to the product pipe 24. The spindle assembly 40 further comprises a rotary motor 44 for rotating the spindle 42.

Figure 3:
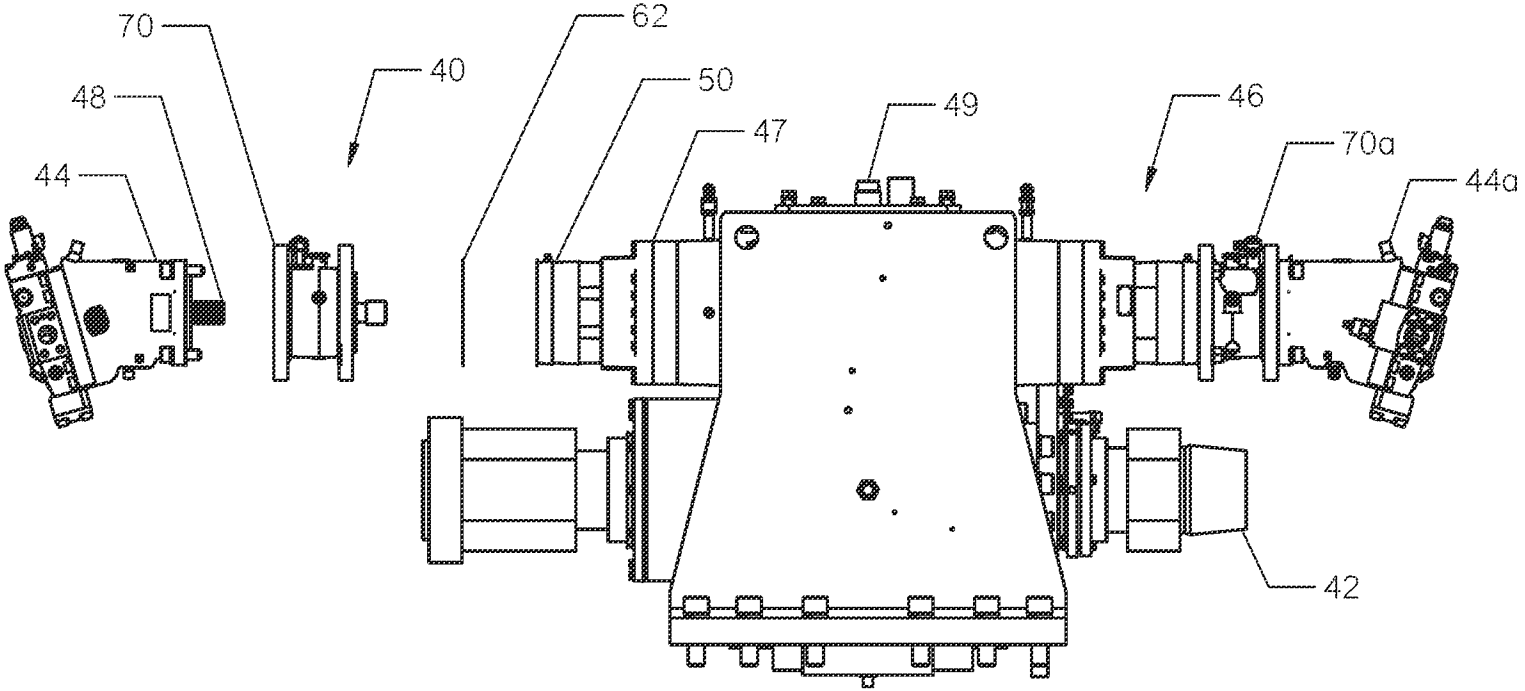
FIG. 3 is an exploded side view of a spindle assembly.
Figure 4:
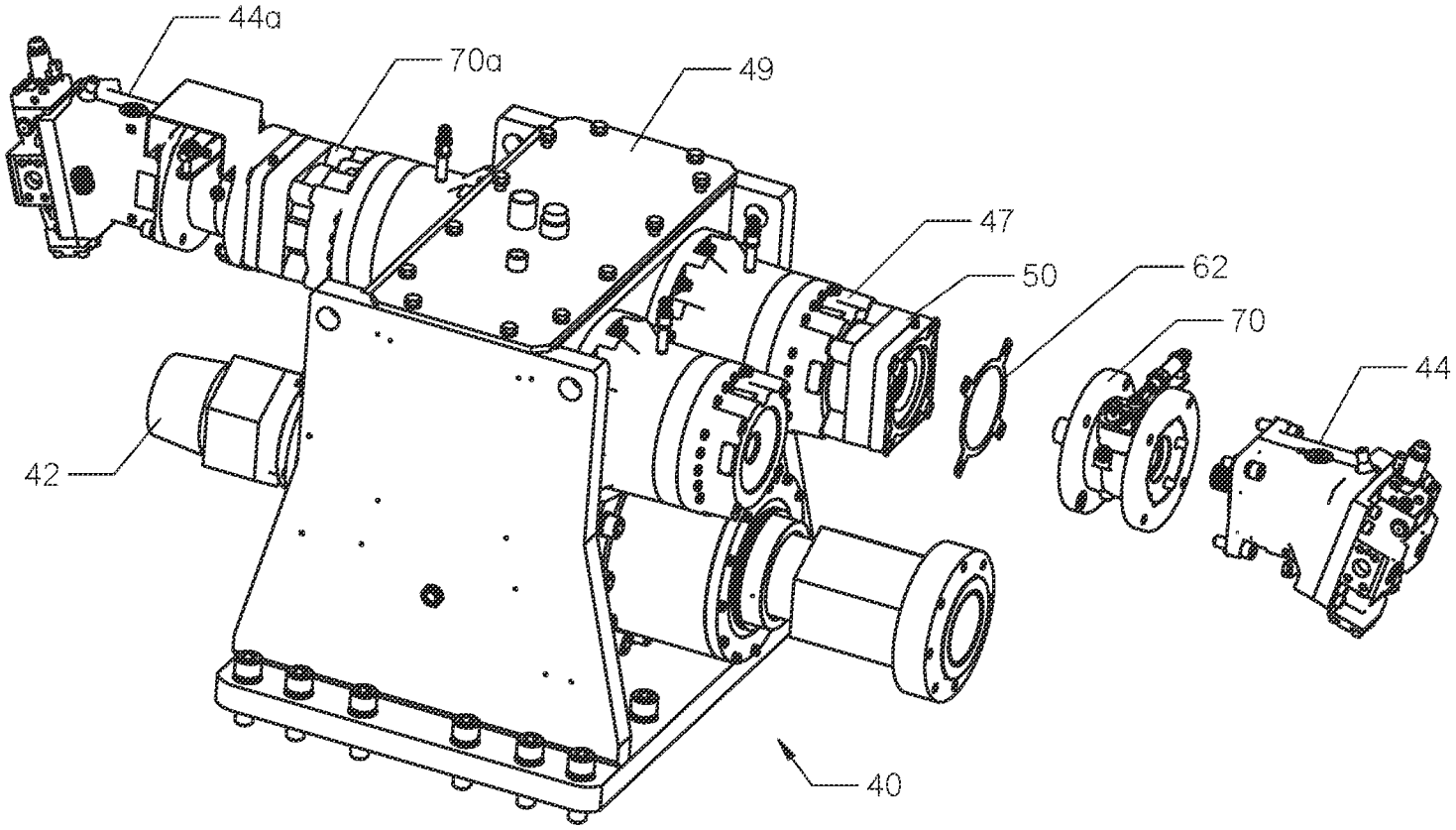
FIG. 4 is an exploded perspective view of the spindle assembly of FIG. 3.

With reference to FIGS. 3 and 4, the spindle assembly 40 further comprises a gear assembly 46. Rotational output generated by the motor 44 is generally in the rotation of a high speed motor output shaft 48. The gear assembly 46 may comprise a planetary gearbox 47 as well as a primary gearbox 49. Other gearing structures may be used. The gear assembly 46 converts high speed rotation imparted by the output shaft 48 into lower speed, higher torque rotational force at the spindle 42.

A rotary brake 50 is disposed between the motor 44 and the gearbox 47. The brake 50 receives a rotational input and directly transfers the rotational input to the gearbox 47 through a rotating shaft. The brake 50 may comprise a pair of opposed brake shoes (not shown) that selectively engage the rotating shaft. When engaged, the brake shoes impart a frictional resistance to the rotating shaft, slowing rotation of the shaft. Continued application of the brake 50 without operation of the motor 44 will stop rotation of the spindle 42. When not engaged, rotation of the spindle 42 is unimpaired by the brake 50.

A mechanical disconnect 70 is provided between the brake 50 and the motor 44. The disconnect 70 allows the spindle assembly 40 of the second drill 30 to operate in a "free spin" mode. Because the pilot drill string 14, back-reamer 20, and product pipe 24 (FIG. 1) are rotationally locked, rotation imparted by the pilot drill 12 will rotate the spindle 42 of the second drill 30. The disconnect 70, when in the disengaged "free spin" mode, will keep such rotation from affecting the rotary motor 44 causing wear and damage to its components. A gasket 62 may be provided to seal the connection between the rotary brake 50 and disconnect 70.

A second disconnect 70*a* may be provided between a second motor 44*a* and the primary gearbox 49. Such a second disconnect 70*a* may be hydraulically linked to the disconnect 70 such that when one of the disconnects 70, 70*a* is in "free spin" mode, the other is as well. Further disconnects may be utilized if additional motors are likewise utilized.

Figure 5:
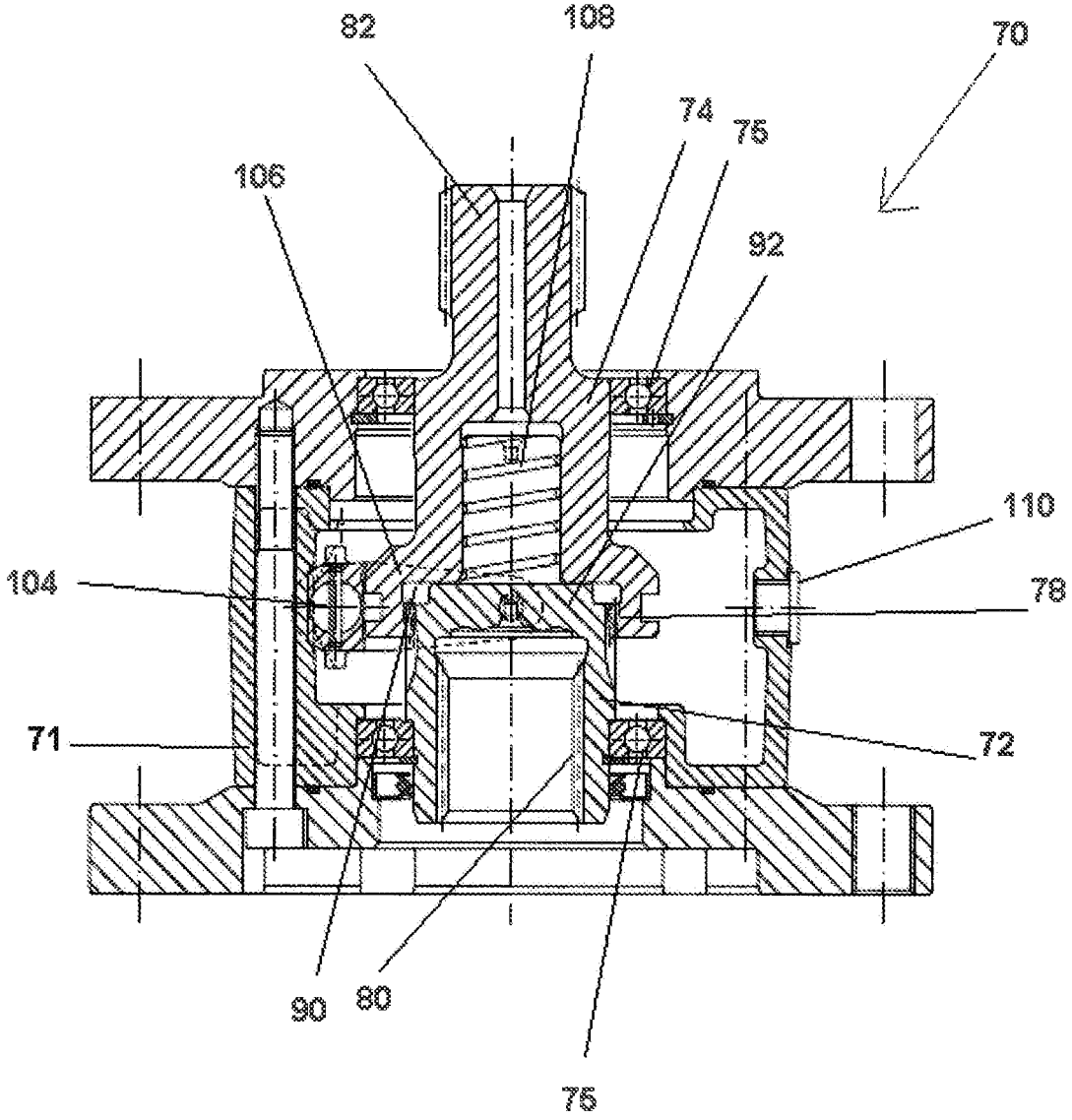
FIG. 5 is a sectional view of a disconnect in engaged position.
Figure 6:
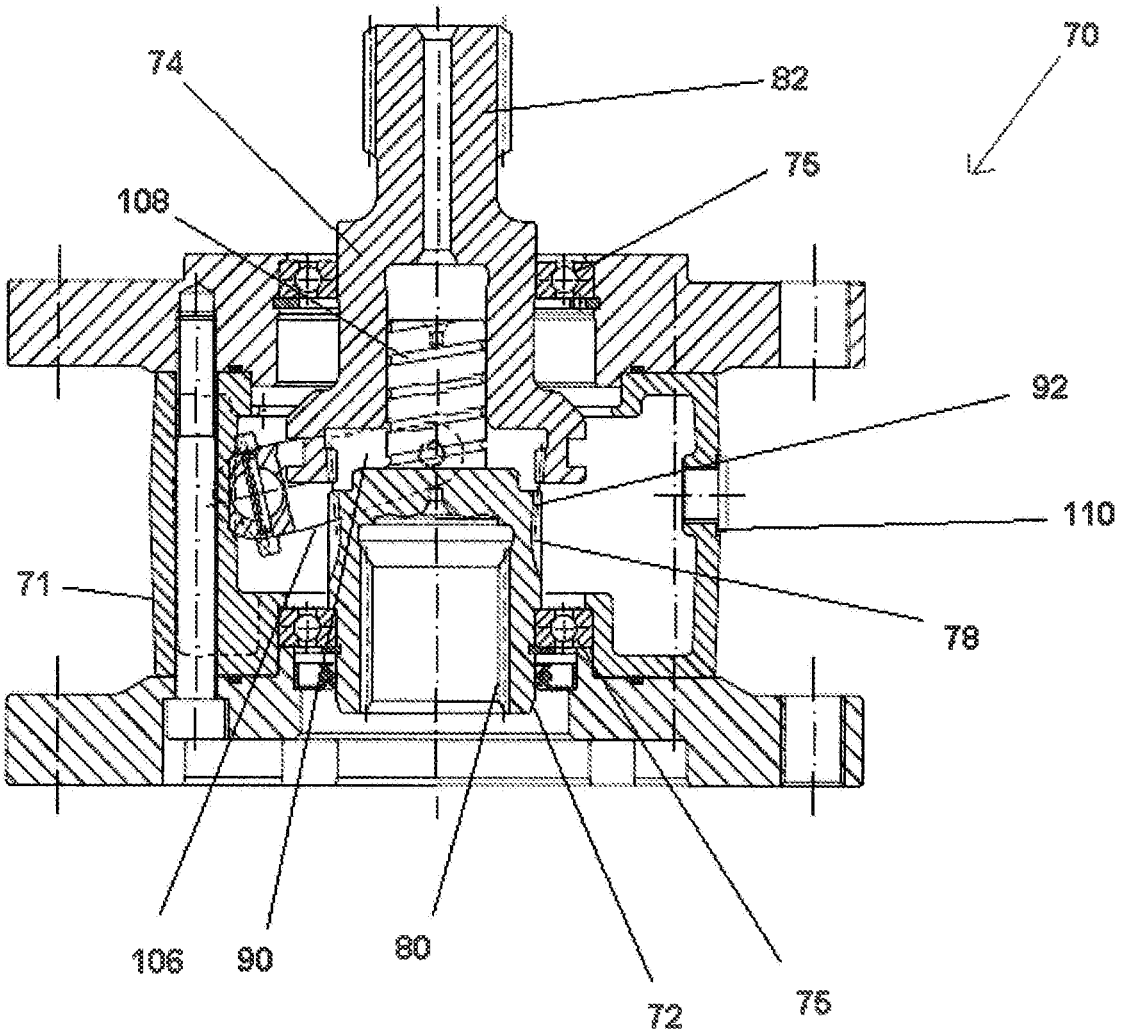
FIG. 6 is a sectional view of the disconnect of FIG. 5 in disengaged position.

With reference to FIGS. 5 and 6, the disconnect 70 is described in detail. The disconnect 70 comprises a frame 71, an input shaft 72, an output shaft 74, and a coupling 78. The input shaft 72 as shown has an input cavity 80 to receive rotational force from the output shaft 48 of the motor 44 (FIG. 3). The cavity 80 and output shaft 48 may comprise complementary shapes, such as splines or polygonal profiles. The input and output shafts 72, 74 may rotate relative to the frame 71. Bearings 75 provided between each of the shafts 72, 74 allow the transfer of torque. The frame 71 may be attached to stationary portions of the adjacent brake 50 and motor 44.

The output shaft 74 comprises a pinion 82 which is coupled through the brake 50 to the gearbox 47 (FIGS. 3-4). The pinion 82 may have a shape that is complementary to a cavity formed in the brake 50, such as a splined or polygonal profile. The pinion 82 is shorter than a full length of the cavity of the brake 50 such that the pinion 82 may travel within the cavity while maintaining engagement with the brake.

The coupling 78 is located at an interface between the output shaft 74 and input shaft 72 of the disconnect. As shown, the output shaft 74 has a cavity 90 with internally disposed splines. The input shaft 72 has a pinion 92 with complementary splines. Geometric interfaces may likewise be used. Further, the coupling 78 may be formed with a pinion on the output shaft 74. In this configuration, the input shaft 72 would have a cavity.

Figure 7:
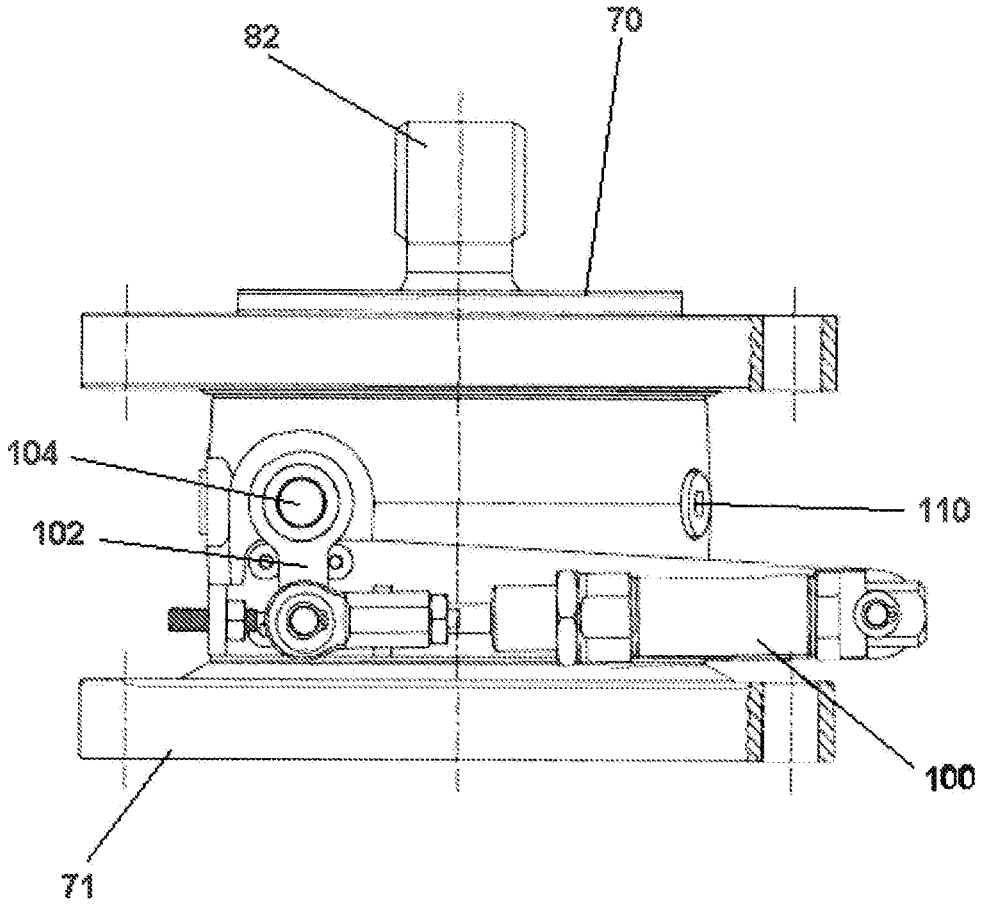
FIG. 7 is a side view of the disconnect of FIG. 5.
Figure 8:
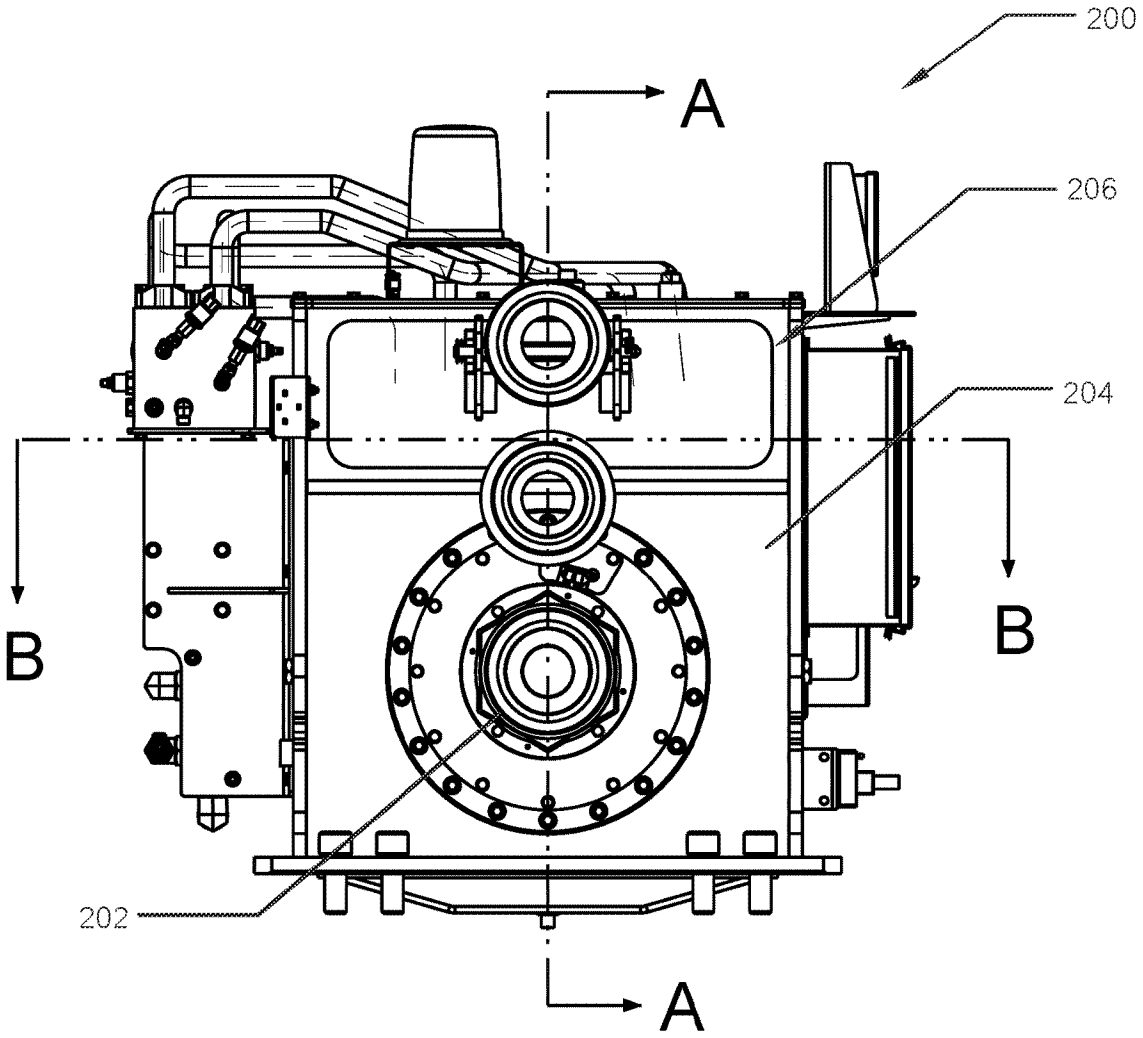
FIG. 8 is a front elevational view of an alternative spindle assembly.
Figure 9:
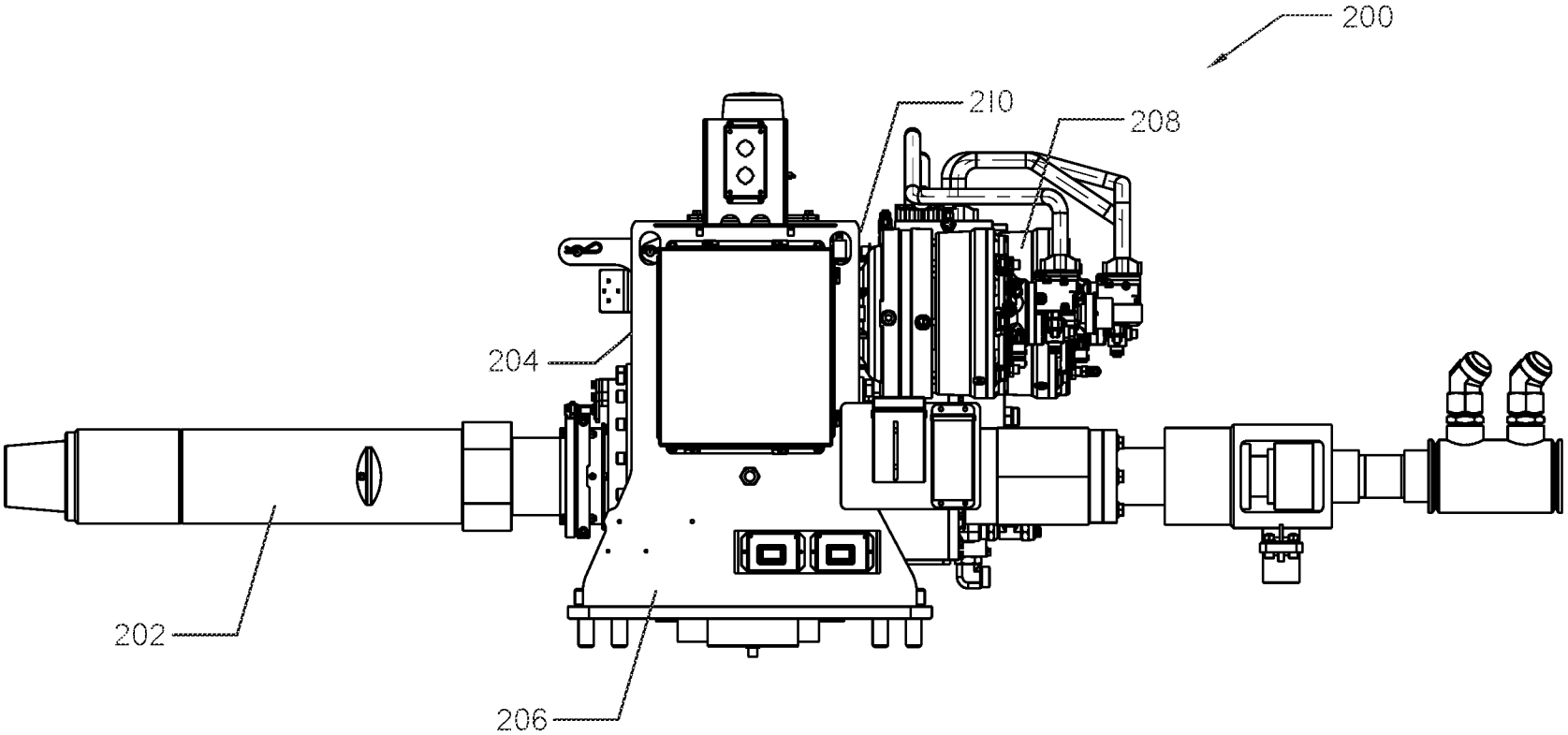
FIG. 9 is a side elevational view of the spindle assembly shown in FIG. 8.
Figure 10:
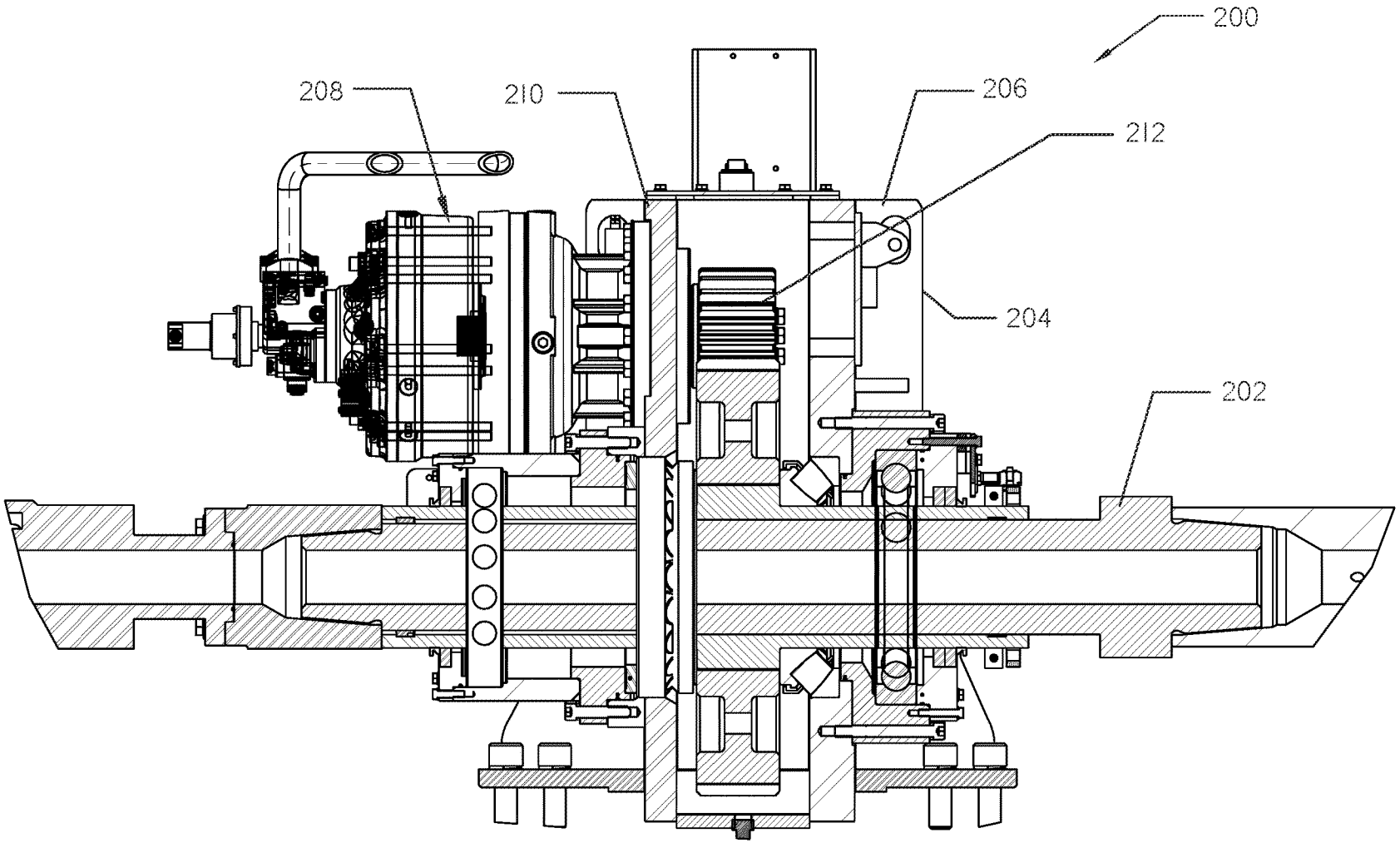
FIG. 10 is a cross-sectional view of the spindle assembly shown in FIG. 8, taken along line A-A.
Figure 11:
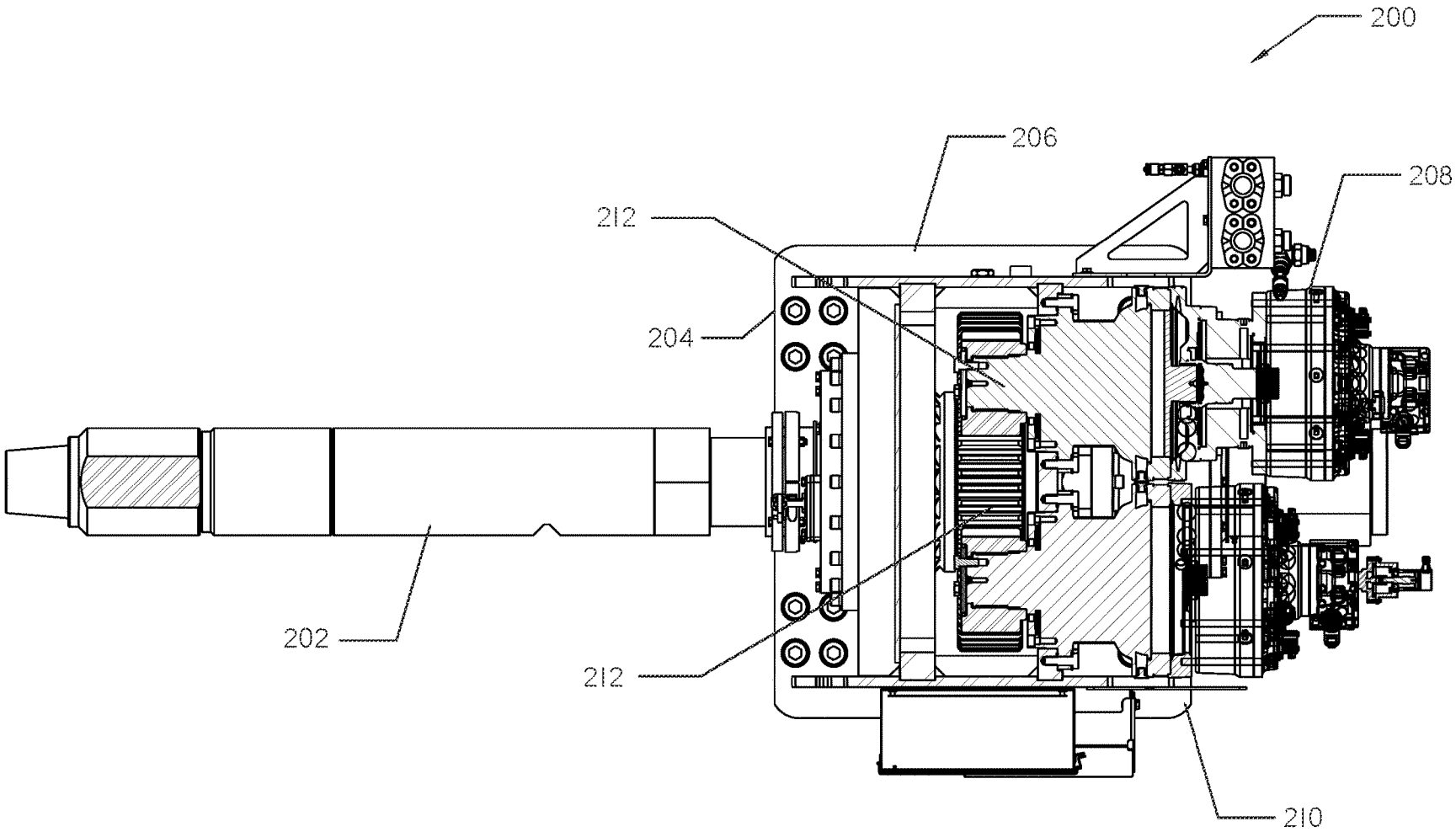
FIG. 11 is a cross-sectional view of the spindle assembly shown in FIG. 8, taken along line B-B.
Figure 12:
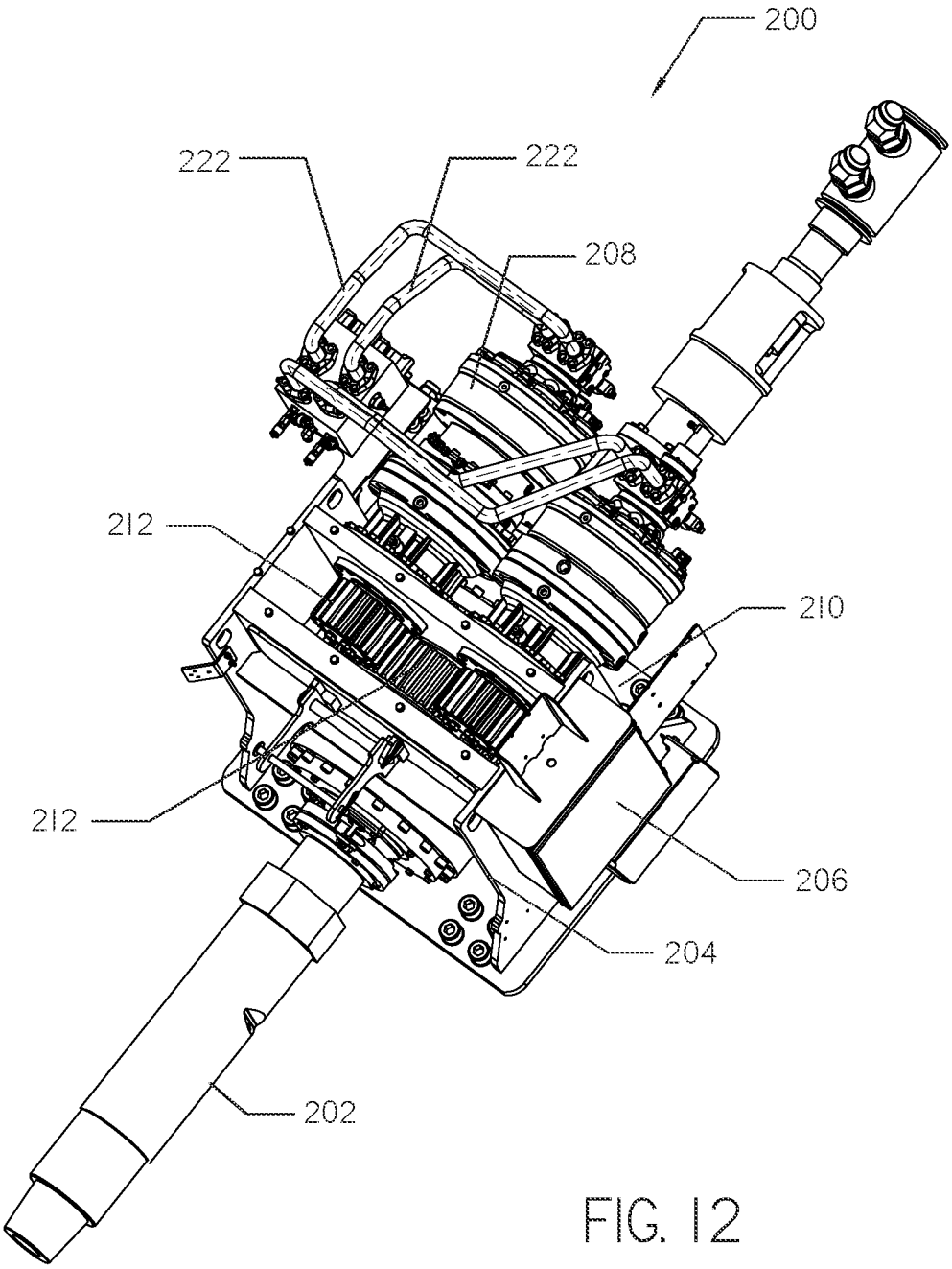
FIG. 12 is a perspective view of the spindle assembly shown in FIG. 8. A portion of the assembly has been removed to expose the inner components.

The coupling 78 has two modes: an engaged mode and a disengaged mode. As shown in FIG. 7, a hydraulic actuator 100 extends between the frame 71 and an external pivot arm 102. The external pivot arm 102 is connected at a pivot point 104 to an internal pivot arm 106. The internal pivot arm 106, as shown in FIGS. 5-6, is attached to the output shaft 74. Movement of the internal pivot arm 106 moves the output shaft 74 such that the splines on the output shaft 72 cavity 90 are engaged or disengaged with the pinion 92 of the input shaft 72 at the coupling 78.

A spring 108 disposed between the pinion 92 and the cavity 90 cushions the engagement between the input shaft 72 and output shaft 74.

When the coupling 78 is in engaged mode, rotation of the output shaft 48 of motor 44 is carried through the disconnect 70. This enables the spindle 42 to make up and break out sections of product pipe 24.

When the second drill 30 assists in pushing the product pipe 24, rotation is driven by the pilot drill 12. Thus, the coupling 78 is placed into disengaged mode. Any rotation of the product pipe 24 and spindle 42 is imparted to the output shaft 74 of the disconnect 70. However, as the coupling 78 is disengaged, the output shaft 74 rotates freely within the frame 71.

The disconnect 70 comprises a vent 110 to prevent pressure buildup due to rotation of the shafts 72, 74 or the movement of the output shaft 74 within the frame 71.

The disconnect 70 may be activated or deactivated from an operator console located on the second drill 30. Alternatively, the disconnect 70 may be operated remotely, or at the pilot drill 12.

Turning to FIGS. 8-12, an alternative spindle assembly 200 for use with the second drill 30 is shown. The assembly 200 comprises a spindle 202 attached to a front end 204 of a gearbox 206 and a rotary motor 208 attached to a rear end 210 of the gearbox 206. A plurality of gears 212, shown in FIGS. 10-12, interconnect the spindle 202 and the motor 208. Rotation of the motor 208 drives rotation of the gears 212, which in turn drive rotation of the spindle 202.

Unlike the spindle assembly 40, the spindle assembly 200 does not include a mechanical disconnect. Rather, the spindle 202 always remains coupled to the motor 208. Because a mechanical disconnect is not used, the motor 208 is configured to move between a first condition and a second condition. In the first condition, the motor 208 drives rotation of the spindle 202, allowing for makeup and breakout of the product pipe sections 24. In the second condition, the motor 208 is configured so that the spindle 202 may freely rotate without resistance from the motor 208. The drill string 14 and product pipe 24 may drive rotation of the spindle 202 when the motor 208 is in the second condition. Because the spindle 202 is still coupled to the motor 208, rotation of the spindle 202 by the drill string 14 and product pipe 24 causes the spindle 202 drive rotation of at least a portion of the motor 208.

Figure 13:
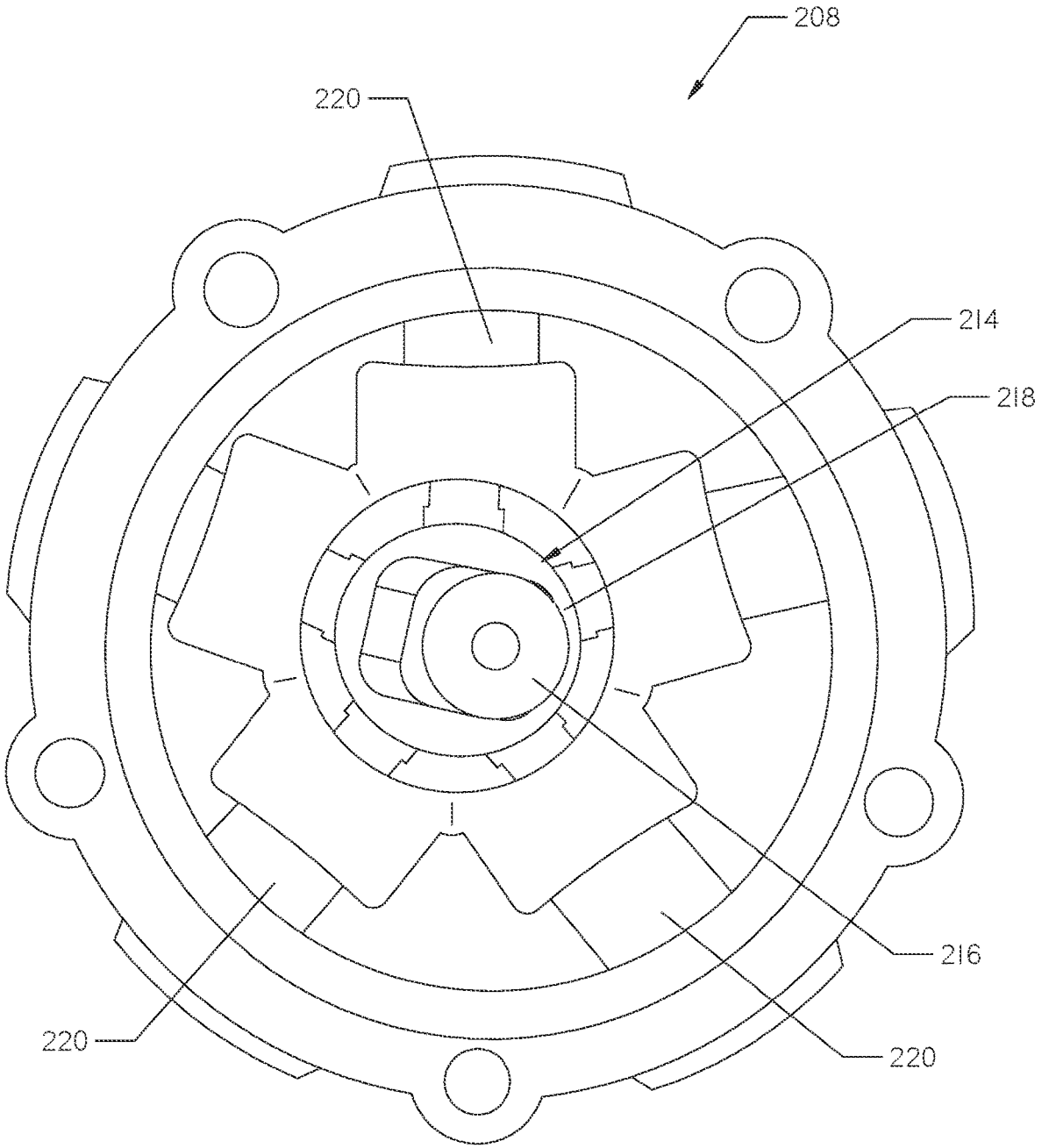
FIG. 13 is a front elevational view of a motor used with the spindle assembly shown in FIGS. 8-12. A portion of the motor has been removed to expose the inner components.

Turning to FIG. 13, the motor 208 comprises an eccentric crank shaft 214. The eccentric crank shaft 214 comprises a crank shaft 216 installed within an eccentric element 218. The eccentric element 218 is engaged with a plurality of radial pistons 220. The pistons 220 are hydraulically powered via hydraulic lines 222, shown in FIG. 12. Differential retraction and extension of the pistons 220 rotates the eccentric element 218, which in turn eccentrically rotates the crank shaft 216.

The crank shaft 216 is coupled to the gears 212. Thus, eccentric rotation of the crank shaft 216 powers rotation of the gears 212, which in turn rotate the spindle 202. The motor 208 is considered to be in the first condition when the crank shaft 216 drives rotation of the spindle 202.

In order for the motor 208 to stop driving rotation of the spindle 202 and move to the second condition, the eccentricity of the crank shaft 216 is reduced to zero. To reduce the eccentricity of the crank shaft 216 to zero, the pistons 220 are extended equally and are hydrostatically balanced against the eccentric element 218. Additionally, the crank shaft 216 is moved so that it is centered within the eccentric element 218. A hydraulic cylinder (not shown) may move the crank shaft 216 within the eccentric element 218. Such operations may take place in response to a command signal sent to a controller within the motor 208.

Once the eccentricity of the crank shaft 216 is reduced to zero, the crank shaft 216 may be turned externally without any resistance from the pistons 220. The crank shaft 216 can thus be turned by the rotating spindle 202, via the gears 212, without damaging the motor 208. The motor 208 is considered to be in the second condition when the spindle 202 is able to drive rotation of the crank shaft 216. Thus, the motor 208 is switched into neutral in the second condition.

While the crank shaft 216 is being turned externally when the motor 208 is in the second condition, motor displacement shifting above zero may cause pressure to build in the pistons 220. This would cause resistance in the drill string 20 and possible damage to the motor 208 and hydraulics. Preferably, an operator of the spindle assembly 200 would be alerted to this condition to determine the cause and remedy the issue.

To return the motor 208 to the first condition, a command signal may be sent to the controller within the motor 208. Such signal may direct the crank shaft 216 to move back to an eccentric position and the pistons 220 to again retract and extend at different times. The motor 208 may be moved between the first and second condition, as needed, during operation of the second drill 30.

Changes may be made in the construction, operation and arrangement of the various parts, elements, steps and procedures described herein without departing from the spirit and scope of the invention as described in the following claims. For example, a control system may be used to actuate each coupling or decoupling event, or a mechanical lever may be used. A hydraulic actuator is described, but other suitable actuators may be used.

The invention claimed is:

1. A horizontal directional drilling system, comprising:
a drill string having multiple segments;
a drilling machine comprising:
a carriage supported on a drill frame and movable relative to the drill frame;
a motor supported on the carriage having an output member configured to connect with and selectively drive rotation of the drill string, wherein the motor is operable in a first mode and a second mode;
wherein the first mode is characterized by the motor applying torque to the drill string through the output member;
wherein the second mode is characterized by the motor being disabled from applying rotational torque to the drill string; and
wherein the system is configured to:
provide thrust with the carriage and rotate the drill string with the output member when the motor is in the first mode; and
provide thrust with the carriage but not rotate the drill string with the output member when the motor is in the second mode; and
wherein the drill string is configured for simultaneous connection to the drilling machine and a second drilling machine, and to receive thrust from the second drilling machine and the drilling machine when the drilling machine is in the first mode.

2. The horizontal directional drilling system of claim 1 wherein the drilling machine is characterized as a first drilling machine and further comprising:
a second drilling machine attached to the drill string.

3. The horizontal directional drilling system of claim 2 wherein the drill string is interrupted at a point intermediate the first drilling machine and the second drilling machine by a backreaming tool.

4. A method of using the system of claim 2 comprising:
rotating and advancing the drill string with the second drilling machine while simultaneously advancing the drill string with the first drilling machine in the second mode;
thereafter, changing the first drilling machine from the second mode to the first mode;
with the first drilling machine in the first mode, rotating and advancing a new pipe segment to connect the first pipe segment to the drill string; and
thereafter, changing the first drilling machine from the first mode to the second mode.

5. The horizontal directional drilling system of claim 1 wherein the system is placed from the first mode into the second mode by hydraulic power provided through a hydraulic line.

6. The horizontal directional drilling system of claim 1 wherein the system is placed from the first mode into the second mode by actuation of a hydraulic actuator.

7. The horizontal directional drilling system of claim 1 wherein the system is placed from the first mode into the second mode by a command signal.

8. The horizontal directional drilling system of claim 1 wherein the motor comprises a crankshaft.

9. The horizontal directional drilling system of claim 8 in which the motor further comprises:
a plurality of radial pistons; and
an eccentric element, positioned by the plurality of radial pistons, wherein the crankshaft is positioned within the eccentric element.

10. The horizontal directional drilling system of claim 9 in which the second mode is characterized by the plurality of radial pistons centering the eccentric element.

11. The horizontal directional drilling system of claim 1 further comprising a spindle carried by the carriage and rotatable by the motor, in which the motor is mechanically disconnected from the spindle in the second mode.

12. The horizontal directional drilling system of claim 1, further comprising a spindle carried by the carriage and rotatable by the motor, in which the motor is capable of receiving rotational force from the spindle in the second mode.

13. The horizontal directional drilling system of claim 1, further comprising a gear assembly coupled to the motor, the gear assembly configured to modulate the torque applied by the motor in the first mode.

14. The horizontal directional drilling system of claim 13 wherein the gear assembly is mechanically decoupled from the motor when in the second mode.

15. The horizontal directional drilling system of claim 1, further comprising a disconnect assembly, the disconnect assembly comprising:
an input shaft coupled with the motor; and
an output shaft;
wherein the input shaft and output shaft are configured to selectively couple, wherein the input shaft and output shaft are torque transmitting in the first mode and are not torque transmitting in the second mode.

16. The horizontal directional drilling system of claim 15 in which the output shaft is defined by a cavity having internally-disposed splines and in which the input shaft comprises a pinion with external splines complementary to the internally-disposed splines of the output shaft.

17. The horizontal directional system of claim 15 further comprising a pivot arm configured to move a selected one of the input shaft and the output shaft in response to the system adjusting from a first one of the first mode and the second mode to a second one of the first mode and the second mode.

18. The horizontal directional drilling system of claim 15 further comprising a spring disposed between the input shaft and the output shaft.

* * * * *